US006578843B2

(12) United States Patent
Honegger

(10) Patent No.: US 6,578,843 B2
(45) Date of Patent: Jun. 17, 2003

(54) METHOD AND APPARATUS FOR CONVEYING PRINTED PRODUCTS

(75) Inventor: Werner Honegger, Bach (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 10/214,689

(22) Filed: Aug. 8, 2002

(65) Prior Publication Data

US 2003/0001333 A1 Jan. 2, 2003

Related U.S. Application Data

(62) Division of application No. 09/832,568, filed on Apr. 11, 2001, now Pat. No. 6,457,708, which is a continuation of application No. PCT/CH99/00389, filed on Aug. 24, 1999.

(30) Foreign Application Priority Data

Oct. 26, 1998 (CH) ..... 2159/98

(51) Int. Cl.[7] ..... B65G 47/86

(52) U.S. Cl. ..... 271/204; 271/82; 271/277; 198/470.1; 198/803.9; 198/803.3

(58) Field of Search ..... 271/277, 204–206, 271/82; 198/470.1, 803.3, 803.7–803.9

(56) References Cited

U.S. PATENT DOCUMENTS 3,955,667 A 5/1976 Muller et al.
4,320,894 A 3/1982 Reist et al.
4,512,457 A 4/1985 Reist et al.
4,905,818 A 3/1990 Houseman
4,953,847 A 9/1990 Honegger
5,007,629 A 4/1991 Eberle et al.
5,295,679 A 3/1994 Reist
5,388,820 A 2/1995 Eberle et al.
5,395,151 A 3/1995 Eberle
6,394,449 B1 * 5/2002 Reist ..... 271/204
2002/0171195 A1 * 11/2002 Lehmann ..... 271/186

FOREIGN PATENT DOCUMENTS

WO WO 86/03476 6/1986

* cited by examiner

*Primary Examiner*—Christopher P. Ellis
*Assistant Examiner*—Mark A. Deuble
(74) *Attorney, Agent, or Firm*—Alston & Bird LLP

(57) ABSTRACT

A method and apparatus for conveying printed products in an imbricated formation with different spacings between the products, from a feed conveyor to the grippers on a removal conveyor. The printed products are introduced into the grippers in groups without any change in the spacing between successive printed products, and the conveying speeds of the feed conveyor and the removal conveyor are coordinated such that the portion of each group of products which projects into a gripper is less than the depth of the mouth of the gripper. Also, a deflection device at the transfer location serves to deflect the leading end of each group of products toward the approaching gripper.

12 Claims, 7 Drawing Sheets

METHOD AND APPARATUS FOR CONVEYING PRINTED PRODUCTS

CROSS REFERENCE TO RELATED APPLICATION

This is a divisional of U.S. application Ser. No. 09/832,568, filed Apr. 11, 2001, now U.S. Pat. No. 6,457,708 which is a continuation of international application PCT/CH99/00389, filed Aug. 24, 1999, and designating the U.S.

BACKGROUND OF THE INVENTION

The present invention relates to a method of, and to an apparatus for, conveying printed products in imbricated formation with different spacings between successive products, from a feed conveyor to the grippers on a removal conveyor. Such a method and such an apparatus are suitable, in particular, for conveying newspapers and periodicals as well as parts thereof and inserts therefor.

CH-A-630 583 and the corresponding U.S. Pat. No. 4,320,894 disclose a method and an apparatus of the above-mentioned type wherein the drives for the feed conveyor and the removal conveyor are independent of one another, that is to say there is no correlation of the conveying speed of the removal conveyor to the timed sequence of the arriving printed products conveyed by the feed conveyor. This means that, on the one hand, the grippers grip a different number of printed products and, on the other hand, the printed products reaching the transfer location may not necessarily come into contact with a gripper. For this reason, the following precautions are taken in order nevertheless to ensure that the printed products are received satisfactorily by in each case one gripper:

Arranged in the transfer region are stop rails against which a printed product which reaches the transfer region earlier than the associated gripper strikes. A printed product butting against the stop rails is prevented from moving any further forward until such time as it is carried along by the associated gripper. Also provided in the transfer region is a deflecting arrangement which has a rotating wheel which is driven by the feed conveyor and on which resilient deflecting fingers are fastened. These deflecting fingers are deflected in each case, by the trailing clamping part of the grippers, into an active position, in which the deflecting fingers serve as a stop for printed products reaching the transfer region late. The printed products positioned against a deflecting finger are deflected downward, out of the normal conveying path, in the region of their leading edge and braked in the process and subsequently then fed to the next gripper.

These two measures taken in the case of the known apparatus ensure that all the printed products are gripped satisfactorily by in each case one gripper, but, as has been mentioned, cause the printed products reaching the transfer region to be braked. This braking of the printed products results in a reduction in the spacing between the braked printed products and the respectively following products. In other words, there is a change in the imbricated formation as it is transferred from the feed conveyor to the removal conveyor.

It is known from EP-A-0 330 868 and the corresponding U.S. Pat. No. 4,953,847 for the printed products which are fed in an imbricated formation, with uniform spacings between the respectively successive printed products, to a transfer location to be received by a removal conveyor with grippers in such a way that each gripper grips in each case two printed products, with the spacing of the latter in the imbricated formation being maintained. This is achieved in that the feeding speed of the feed conveyor and the conveying speed of the removal conveyor are selected such that, during the time in which the fed printed products cover double the spacing between two printed products, the grippers of the removal conveyor cover a distance which corresponds to the fixed spacing between two grippers.

The object of the present invention, then, is to provide a method and an apparatus of the type mentioned in the introduction which make it possible, in a straightforward manner, for the printed products which are fed with irregular mutual spacings to the transfer location to be received satisfactorily and carefully by the grippers of the removal conveyor without it being necessary, for this purpose, for individual products to be braked and displaced.

SUMMARY OF THE INVENTION

The above and other objects and advantages of the invention are achieved by the provision of a method and apparatus wherein the printed products are introduced into the grippers of the removal conveyor without any change in the spacing between successive printed products, so that each gripper grips the number of printed products fed to it with the same mutual spacing as in the imbricated formation. Also, once a number of printed products have been received by a gripper, the following printed products are directed into an open mouth of the next gripper, with the spacing being maintained between the last printed product gripped by the preceding gripper and the following printed product.

The present invention is based on the finding that the printed products can be transferred from the feed conveyor to the removal conveyor, while maintaining their mutual spacing, if it is ensured that, on the one hand, the printed products running into a gripper in each case are not inhibited in their forward movement prior to the closure of the gripper and, on the other hand, the following printed products which cannot be gripped correctly by the preceding gripper are directed to the open mouth of the next gripper while maintaining their mutual spacing.

BRIEF DESCRIPTION OF THE DRAWINGS

Preferred exemplary embodiments of the subject matter of the invention are explained in more detail hereinbelow with reference to the drawings, in which, purely schematically.

DETAILED DESCRIPTION OF THE PREFERRED EMBODIMENT

Figure 1:
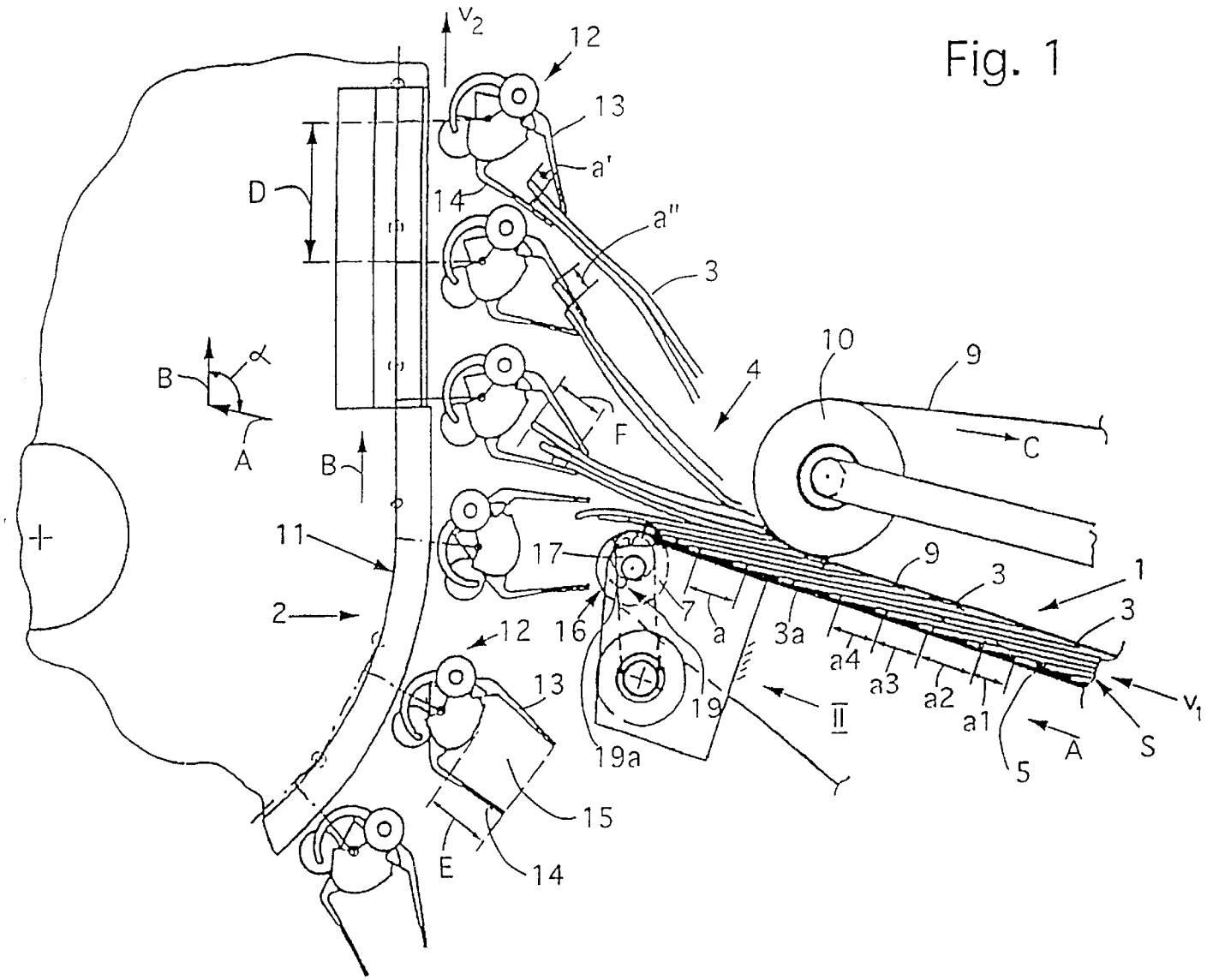
FIG. 1 shows a side view of a first embodiment of a conveying apparatus according to the invention.
Figure 2:
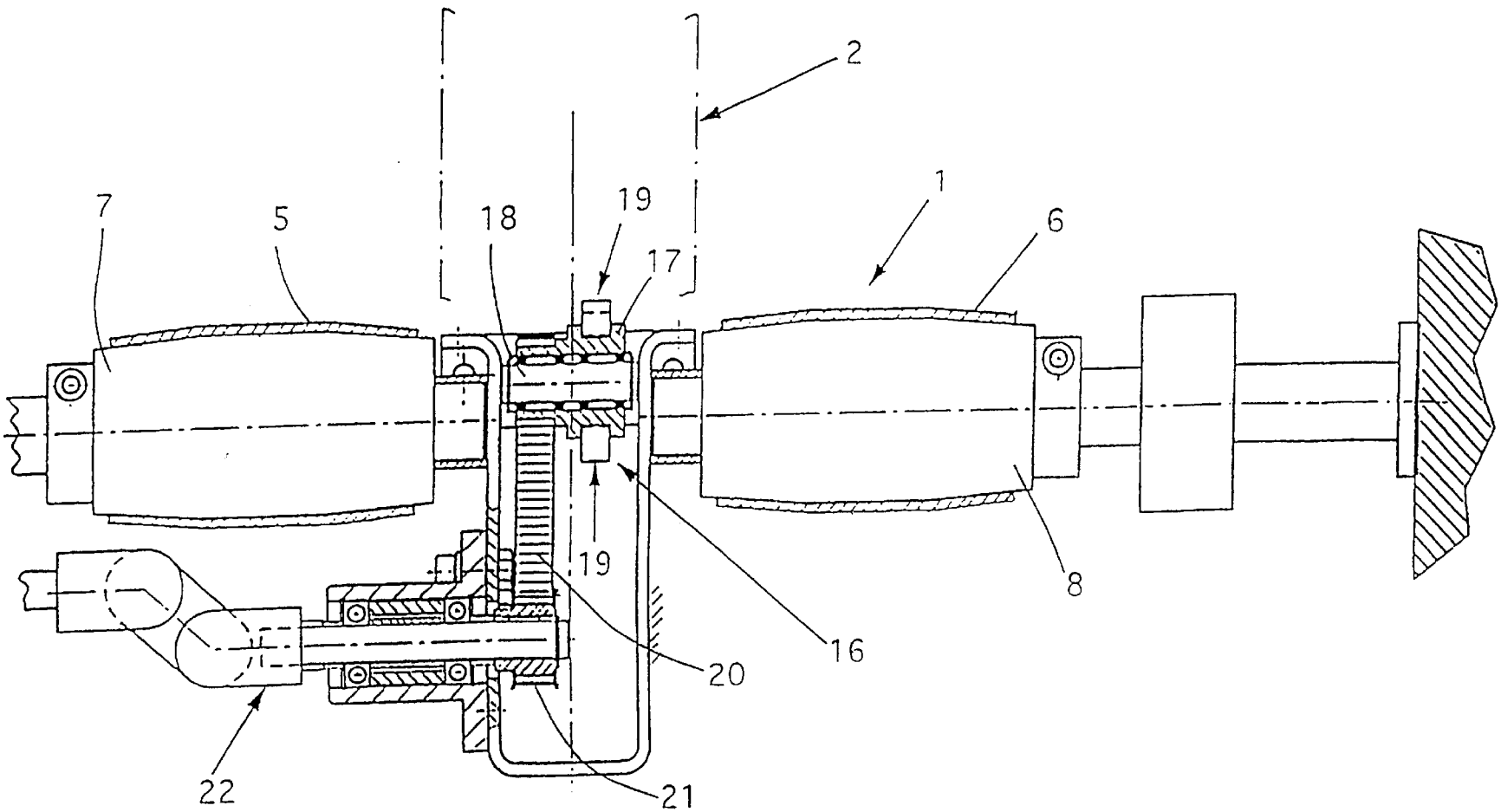
FIG. 2 shows a view in the direction of the arrow II in FIG. 1, and partially in group, of the end region of the feed conveyor of the conveying apparatus according to FIG. 1, FIGS. 3*a–d* show how the operation of the grippers of the removal conveyor receiving printed products proceeds over time.

The first embodiment of a conveying apparatus according to the invention illustrated schematically in FIGS. 1 and 2 has a feed conveyor 1 and a removal conveyor 2. The conveying direction of the feed conveyor 1 is designated A and the conveying direction of the removal conveyor 2 is designated B. In the exemplary embodiment illustrated, the two conveyors 1, 2 are arranged such that the conveying direction A and the conveying direction B form an angle $\alpha$ which is greater than 90°, as is illustrated in FIG. 1. This means that the conveying direction B of the removal conveyor 2 has a component which is parallel to the conveying direction A of the feed conveyor 1 and runs in the same direction as A. The feed conveyor 1 conveys printed products 3 in an imbricated formation S, at the conveying speed v1, to a transfer location 4. The printed products 3 may be newspapers, periodicals and the like or parts thereof, and inserts therefor. In the exemplary embodiment shown, in the imbricated formation S, in each case one printed product 3 rests on the following printed product. This means that, in the imbricated formation S, the leading edges 3*a* of the printed products 3 are located at the bottom, i.e. rest on the feed conveyor 1.

In the imbricated formation S, the imbrication spacings a, i.e. the spacings between the leading edges 3*a* of successive printed products 3, are irregular, as is shown in FIG. 1 with reference to the spacings a1, a2, a3 and a4. These spacings a1 to a4 differ from one another but, in certain cases, it is quite possible for them also to be the same. In other words, the printed products 3 are located in an irregular manner in the imbricated formation S.

The feed conveyor 1 is formed by two conveying belts 5, 6 which are arranged parallel to one another and are spaced apart from one another (FIG. 2). The two conveying belts 5, 6 are each guided over deflecting rollers, of which only the end-side deflecting rollers 7, 8 are shown. The two conveying belts 5, 6 are driven at the speed v1.

Arranged above the feed conveyor 1 is a pressure-exerting belt 9 which is driven in circulation in the direction of the arrow C. This pressure-exerting belt 9 is likewise guided over deflecting rollers, of which only one deflecting roller 10, which also serves as a pressure-exerting roller, is shown. The imbricated formation S is guided between the pressure-exerting belt and the deflecting roller 10 and the feed conveyor 1 and is pressed onto the feed conveyor 1 in the process. The deflecting roller 10 is set back by a certain distance in relation to the deflecting rollers 7, 8.

The removal conveyor 2 has a drawing element (not illustrated) which is guided in a guide channel 11 and is driven in circulation in conveying direction B at the conveying speed v2. Grippers 12 are fastened at fixed and identical spacings D one behind the other on said drawing element. The grippers shown in FIG. 1 correspond, in terms of design and function, to the grippers described in EP-A-0 600 183 and the corresponding U.S. Pat. No. 5,395,151. For this reason, you are referred to these documents as regards construction and functioning of the grippers 12. It goes without saying that it is also possible to use grippers of some other suitable design. Each gripper has two clamping parts 13, 14 which can be moved toward one another into a clamping position and away from one another into an open position. In order to control the movement of the clamping parts 13, 14, and to pivot the grippers 12, control arrangements (not illustrated specifically), e.g. guide elements, are provided. The gripper mouth defined by the two clamping parts 13, 14 is designated 15.

Arranged in the end region of the feed conveyor, between the two deflecting rollers 7, 8, is a deflecting arrangement 16 which has a wheel 17 which is mounted rotatably on a pin 18. Fastened on the circumference of the wheel 17 are two diametrically opposite deflecting elements 19 which are of L-shaped design in side view. One leg 19*a* of the deflecting elements 19 is spaced apart from the circumference of the wheel 17 and serves as a directing part, as will be explained in more detail with reference to FIGS. 3 and 4. The wheel 17 is driven, via a toothed belt 20, by a gearwheel 21 which, for its part, is driven via a jointed shaft 22 (FIG. 2). The varying drive speed of the wheel 17, i.e. the movement speed of the deflecting elements 19, is coordinated with the conveying speed v1 of the feed conveyor 1 and the position of the grippers 12 of the removal conveyor 2.

The conveying speeds v1 and v2 relate to one another in a given, fixed ratio, although this may be adjusted.

It can be seen from FIG. 1 that the printed products 3, which are fed at a constant conveying speed v1 to the transfer location 4, are conveyed to the grippers 12 of the removal conveyor 2, and gripped by said grippers in groups, without any change in the original mutual spacing a of the printed products 3 in the imbricated formation S. In this case, depending on the size of the mutual spacing a between respectively successive printed products 3, each gripper 12 grips different numbers of printed products 3. It is ensured here, by coordination of the conveying speeds v1 and v2 and with account being taken of the gripper spacing D, that the length F of that portion of a received group which projects into a gripper mouth 15 is smaller than the depth E of the clamp mouth 15, so that no printed product 3 strikes against a gripper part, and is braked in the process, as it runs into a gripper 12. F thus designates the distance in which are located those edges of the printed products 3 which are gripped by a gripper 12, it being necessary to ensure that the rearmost printed product 3 still gripped by a gripper 12 projects into the gripper mouth 15 to a sufficiently large extent for this printed product also still to be reliably secured. The printed products 3 of a group which are gripped by a gripper 12 and conveyed away thus have the same mutual spacing a' or a" as in the fed imbricated formation S.

By way of the deflecting elements 19 dipping periodically into the imbrication formation S, the deflecting arrangement 16 ensures, in a manner which is still to be described, that the individual groups are separated from one another and the first printed products of the respectively following group are directed to the next gripper 12. The deflecting element 16, however, only acts if the spacing between the rearmost printed product of one group and the foremost printed product of the following group is such that it is not ensured that said foremost printed product will be directed satisfactorily into the next gripper.

The functioning of the conveying apparatus according to FIGS. 1 and 2 will now be explained with reference to FIG. 3, which is simplified in relation to FIG. 1. FIGS. 3*a* to 3*d* illustrate four phases, following one after the other in time, during the transfer of the printed products 3 from the feed conveyor 1 to the removal conveyor 2. Just as in FIG. 1, F designates the lengths of that portion of a group which projects into a gripper mouth 15, said length, as has been mentioned, being smaller than the gripper-mouth depth E. The front boundaries of each of these groups are designated 23, 23' and 23".

At the point in time according to the illustration of FIG. 3*a*, the grippers 12' and 12" have already received the printed products 3 of the groups s1 and s2 respectively assigned to them, while the next gripper 12 is reaching the transfer location and is ready for receiving the printed products 3 of the next group s3. At this point in time, the first printed product 3' of the next group s3 comes into the region of action of a deflecting element 19 of a deflecting arrangement 16 and, as will be explained with reference to FIG. 4, is deflected out of the normal conveying path 24, which is defined by the feed conveyor 1.

At a somewhat later point in time according to the illustration of FIG. 3*b*, the printed products 3 in the imbricated formation S have already moved on, while the wheel 17, with the deflecting elements 19, has rotated somewhat further. From FIG. 3*b*, it is possible to see the commencing deflection of the incoming printed products out of the normal conveying path 24 under the action of a deflecting element 19.

At a somewhat later point in time, at least the foremost printed products of the next group s3, which is to be received by the following gripper 12, have already been clearly deflected out of the normal conveying path 24 into an alternative conveying path 25, which is oriented in the direction counter to the conveying direction B of the removal conveyor 2, as can be seen in FIG. 3*c*. It can also be seen from FIG. 3*c* that, by virtue of this deflection of the printed products onto the alternative conveying path 25, it is ensured that the printed products are reliably directed into the open mouth 15 of the gripper 12.

At the point in time according to the illustration of FIG. 3*d*, the printed products of the group s3, which is to be received by the gripper 12, have been directed into the gripper mouth 15 and are ready to be firmly clamped. The clamping parts 13, 14 of the gripper 12 are then closed. The deflecting element 19 of the deflecting arrangement 16 has released the printed products which it previously deflected onto the alternative conveying path 25. According to the illustration of FIG. 3*d*, the other deflecting element 19 then moves into the incoming imbricated formation S from beneath, but does not act on the first printed product of the next group s4 since said product has a sufficiently large spacing in order to run satisfactorily into the next gripper 12 by the direct route.

The functioning of the deflecting arrangement 16 will now be explained in more detail with reference to FIG. 4.

FIGS. 4*a* to 4*f* show the wheel 17, which rotates in the direction of the arrow G, with the two deflecting elements 19 in different positions following one after the other in time.

In FIG. 4*a*, the wheel 17 and the deflecting elements 19 assume approximately the same position as the wheel 17 in FIG. 3*d*. In this case, the deflecting element 19 engages in the imbricated formation S and raises the leading printed products, i.e. the final printed products of the preceding group, to some extent. At this point in time, the movement speed v3 of the deflecting elements 19 is somewhat greater than the advancement speed v1 of the imbricated formation S, in order to catch up with, and overtake, the conveyed printed products 3.

In that position of the wheel 17 which is shown in FIG. 4*b*, the movement speed v3 of the deflecting elements 19 is lower than the conveying speed v1 of the printed products 3, the movement speed v3 decreasing. This, then, allows the printed products of the next group (illustrated by a single printed product 3 in FIGS. 4*a* to 4*f*) to catch up with the deflecting element 19 (FIG. 4*c*). The foremost printed product 3 of this group then comes into the region of action of a deflecting element 19 and moves, by way of its leading edge 3*a*, into the interspace between the circumferential surface of the wheel 17 and the directing part 19*a* of the deflecting element 19 (see FIGS. 4*c* and 4*d*).

By virtue of the deflecting element 19, which now has essentially the same speed as the printed product 3, the printed product is then deflected out of the normal conveying path 24 onto the alternative conveying path 25, as has already been described with reference to FIG. 3 and is shown in FIG. 4*e*.

The wheel 17 is then accelerated, which results in the movement speed v3 of the deflecting element 19 being greater than the advancement speed v1 of the printed product 3. It is thus possible for the deflecting element 19 to be released from the printed product 3, with the result that, during the further advancement, said printed product can run into the open mouth of the associated gripper, as has already been described with reference to FIG. 3 (see FIG. 4*f*).

It can be gathered from above that the wheel 17 is driven at changing circumferential speed in order first of all to make it possible for the printed products to catch up with the deflecting elements 19, subsequently to allow a printed product 3 to move into the deflecting element 19, and then to ensure that the deflected printed product 3 is released by the deflecting element 19. It is important that the movement speed of the deflecting element 19 is such that the leading edge 3*a* of a printed product 3 never strikes against a deflecting element 19. This means that the printed products 3 are deflected onto the alternative conveying path 25 without being braked or accelerated. This ensures that the spacing a between successive printed products 3 is maintained even during the deflecting operation.

As has been mentioned, the deflecting roller 10, and thus the end of the pressure exerting belt 9, is set back in relation to the end of the feed conveyor 1. The distance by which it is set back, then, is selected such that the printed products 3 of each group remain in the region of influence of the deflecting roller 10 until they are secured at their leading end 3*a* by the clamping parts 13, 14 of a gripper 12. The action of the printed products of each group being pressed onto the feed conveyor 1 in this way during the transfer operation helps to maintain, as desired, the mutual position of the printed products during the transfer.

Figure 5:
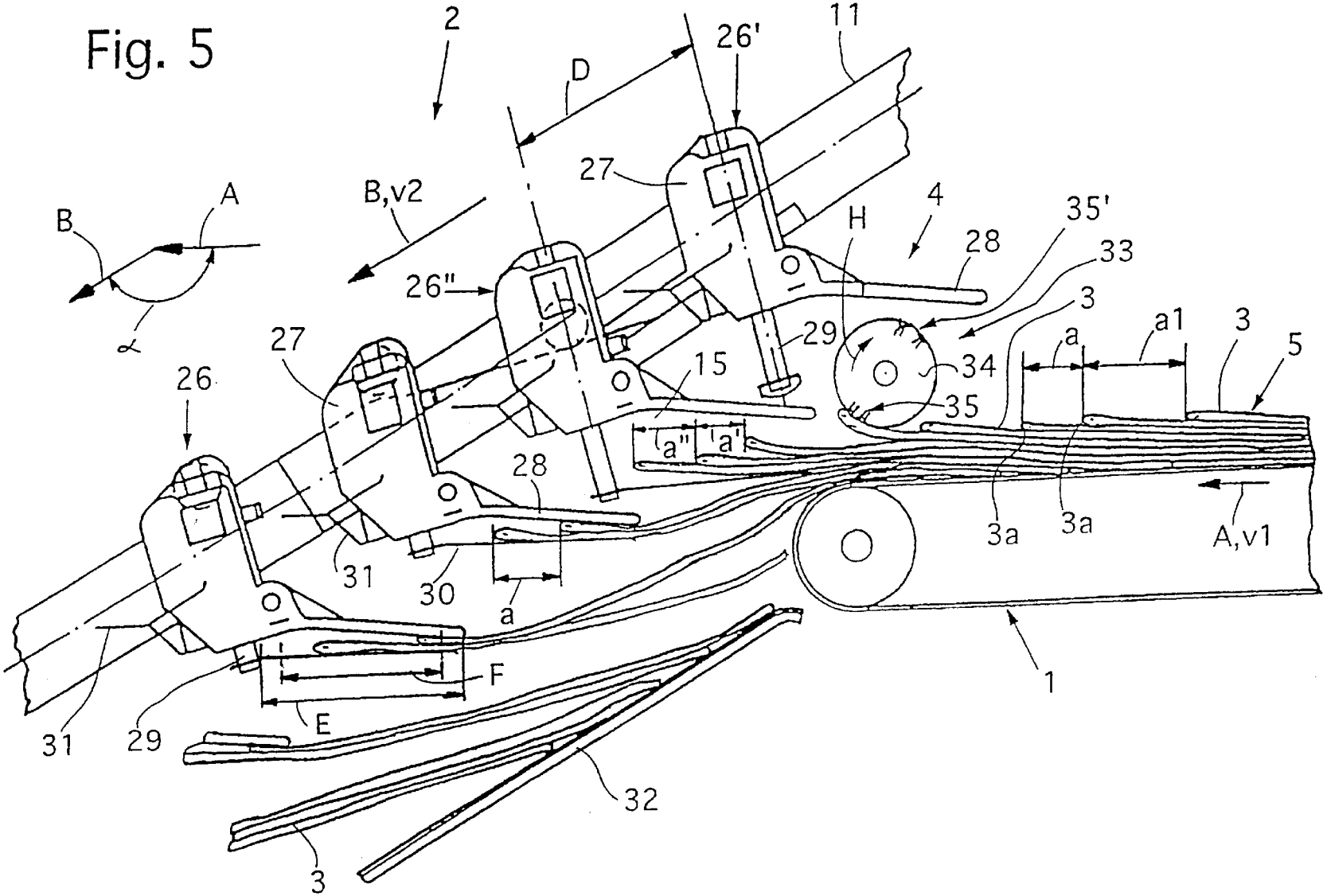
FIG. 5 shows a side view of a second embodiment of a conveying apparatus according to the invention, FIGS. 6*a* and *b* show a simplified side view of a third embodiment of a conveying apparatus according to the invention in two product-receiving phases following one after the other in time.

In the second embodiment of a conveying apparatus according to the invention, this embodiment being shown in FIG. 5, a feed conveyor 1 and a removal conveyor 2 are likewise provided. The feed conveyor 1 supplies the printed products 3 in an imbricated formation S in the direction of the arrow A, at a conveying speed v1, to a transfer location 4. In contrast to the embodiment according to FIGS. 1 and 2, in this imbricated formation S, each printed product 3 rests on the preceding printed product. This means that, in this fed imbricated formation S, the leading edges 3*a* of the printed products 3 are located at the top. It is also the case in this embodiment that the spacings a, a1 between respectively successive printed products 3 are irregular.

The removal conveyor 2 receives the fed printed products in groups at the transfer location 4 and conveys them away in the direction of the arrow B at the conveying speed v2. The conveying direction B of the removal conveyor 2 and the conveying direction A of the feed conveyor 1 form an obtuse angle. This means that, just as in the embodiment according to FIGS. 1 and 2, the conveying direction B has a component which runs parallel to the conveying direction A and in the same direction as A. The conveying speeds v1 and v2 relate to one another in a given, fixed ratio, which can be changed.

The removal conveyor 2 likewise has a drawing element (not shown) which is guided in a guide channel 11. Grippers 26 are arranged at uniform, fixed spacings B on said drawing element, although they differ in design from the grippers 12 of the removal conveyor 2 according to FIG. 1. Note CH-A-592 562 and the corresponding U.S. Pat. No. 3,955, 667 with regard to the construction and functioning of the grippers 26. Each gripper 26 has a gripper housing 27 which is fastened on the abovementioned drawing element in a non-pivotable manner. A fixed clamping part 28 is formed on each gripper housing 27. In the gripper housing 27, a shank 29 is mounted such that it can be displaced in the direction of its longitudinal axis and pivoted about the latter. The shank 29 is prestressed in the direction of the open position, as is illustrated in FIG. 5 for the rearmost gripper 26', as seen in the conveying direction B, by a spring (not shown). Fastened on the shank 29 is a movable clamping part 30 which, in the open position of the gripper 26', is pivoted through approximately 90° in relation to the conveying direction B.

By virtue of correspondingly designed control arrangements, which comprise for example stationary guide elements, the shank 29, together with the movable clamping part 30, are pivoted through approximately 90° and moved into a position in which the movable clamping part 30 runs approximately parallel to the fixed clamping part 28 and thus forms the gripper mouth 15, as is shown in FIG. 5 for the gripper 26". In order to close the grippers 26, the shank 29 is displaced in the direction of its longitudinal axis, likewise by means of suitable control arrangements, and the two clamping parts 28, 30 are thus brought together. The shank 29 is arrested in its closed position by means of a releasable locking element 31.

Following the transfer location 4, beneath the removal conveyor 2, there is arranged a directing plate 32 which runs approximately parallel to the conveying direction B and by means of which the printed products 3 guided away by the grippers 26 are supported in the region of their trailing edges.

Provided in the region of the discharge end of the feed conveyor 1, and at the transfer location 4, is a deflecting arrangement 33 which has a roller 34 which is driven in rotation in the direction of the arrow H. This roller 34 is provided with two diametrically opposite suction regions 35, 35'. These suction regions 35, 35' (not illustrated in any more detail) have holes which can be connected periodically to a negative pressure source. The rotational speed of the roller 34 is coordinated with the conveying speed v2 of the removal conveyor 2 such that one of the suction regions 35, 35' comes into contact with a printed product 3 of the fed imbricated formation S in each case when the trailing, fixed clamping part 28 of a gripper 26 is about to leave the transfer location 4. This is because the roller 34 has the same task as the deflecting arrangement 16 in the exemplary embodiment according to FIGS. 1 and 2 and serves, if necessary, for deflecting in each case the first printed product 3 of a group out of the normal conveying path onto an alternative conveying path, which is directed counter to the conveying direction B of the removal conveyor 2. Each time one of the suction regions 35, 35' comes into contact with a printed product 3 in the imbricated formation S, the holes of the suction region 35, 35' are connected to the negative-pressure source. The roller 34 thus carries along the gripped region of the corresponding printed product 3 and deflects it towards the next gripper (in FIG. 5, the gripper 26').

Just as in the embodiment according to FIGS. 1 and 2, the printed products 3 are fed to the grippers 26 at the conveying speed v1 and gripped, and carried along, by the grippers in groups. This likewise ensures that the length F of that portion of the formation which projects into the mouth of the grippers 26 is smaller than the depth E of the grippers 26, with the result that there is no mutual displacement of the printed products 3 as the latter are received by the grippers 26. The printed products secured by the clamping parts 28, 30 of a gripper 26 thus have the same mutual spacing a', a" as in the imbricated formation S fed by the feed conveyor 1.

Since the roller 34 of the deflecting arrangement 33 has a circumferential speed which corresponds to the feeding speed v1, the printed products 3 gripped by the roller 34 also maintain their speed. This avoids the situation where the printed products gripped by the roller 34 are displaced in relation to the following printed products.

Figure 3:
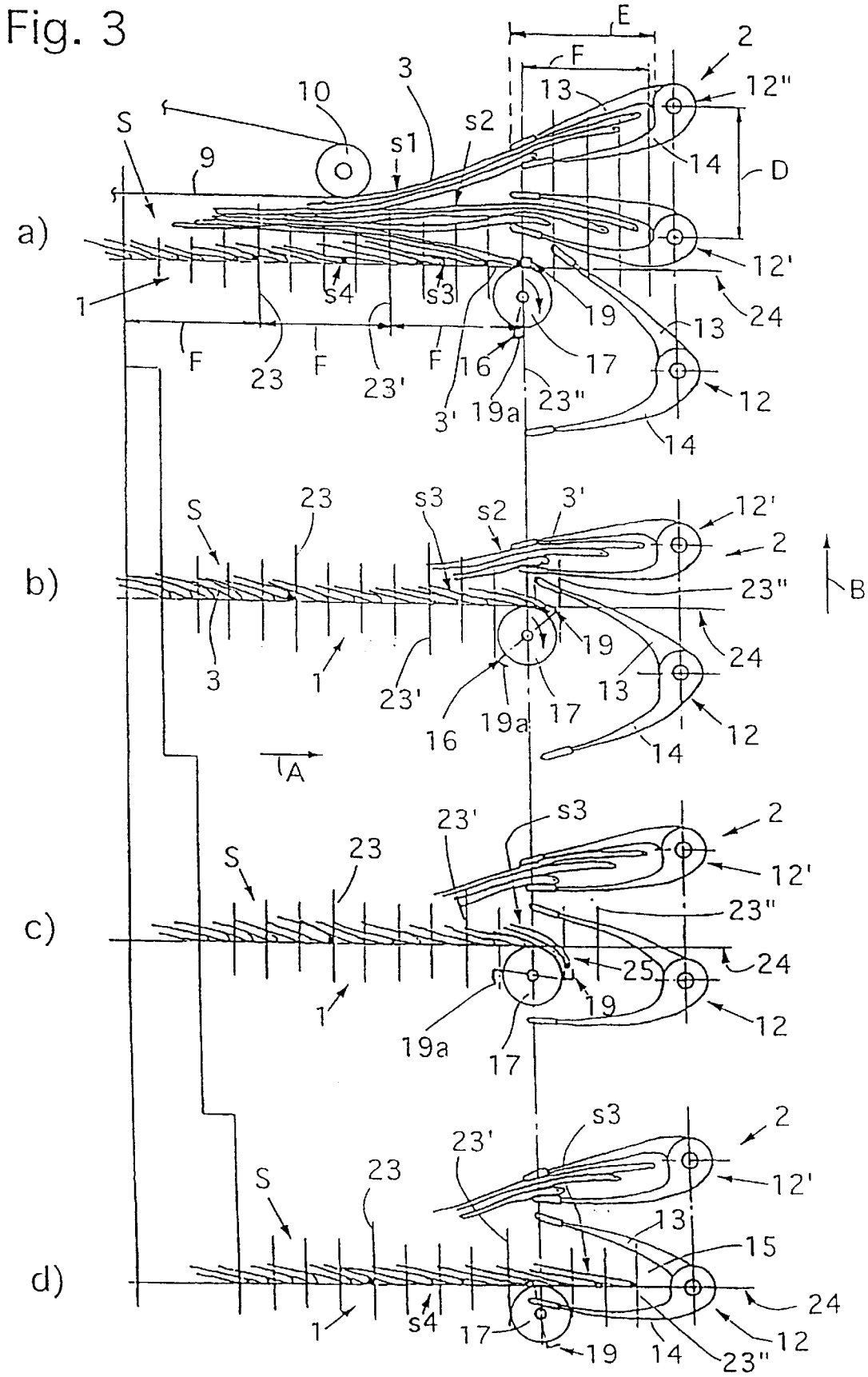
Figure 4:
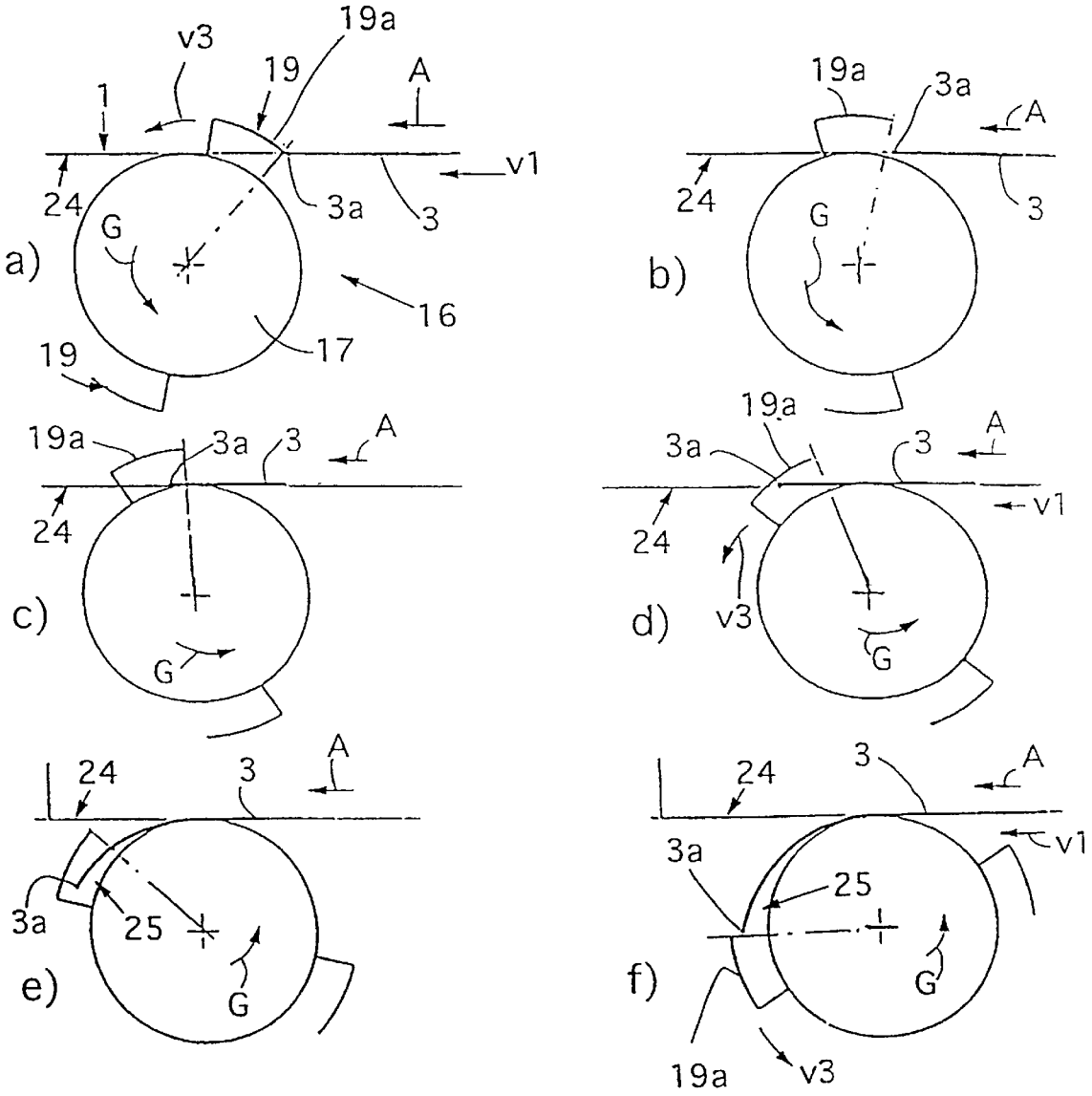
FIGS. 4*a–f* show the deflecting arrangement in different phases following one after the other in time.
Figure 6:
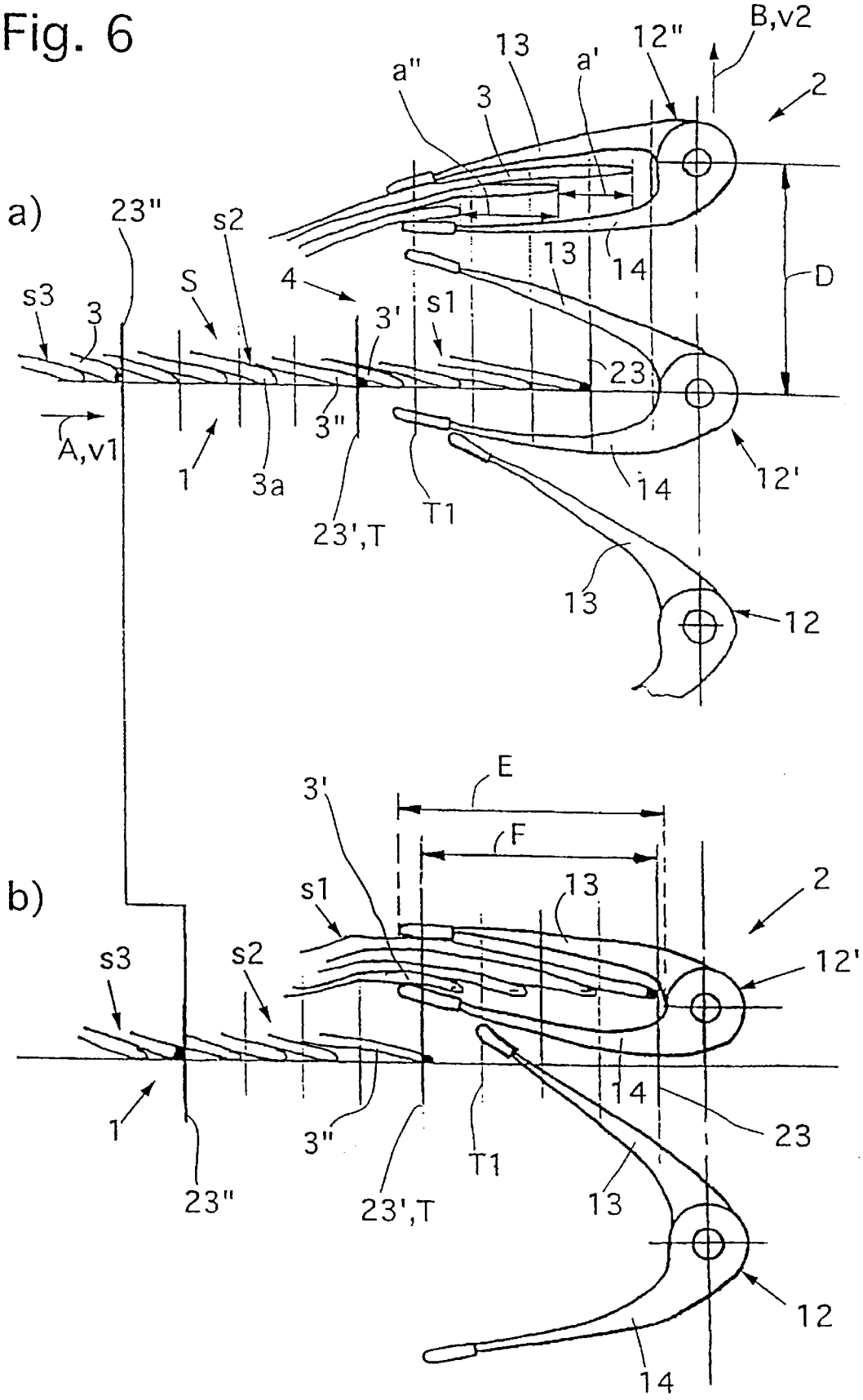
Figure 7:
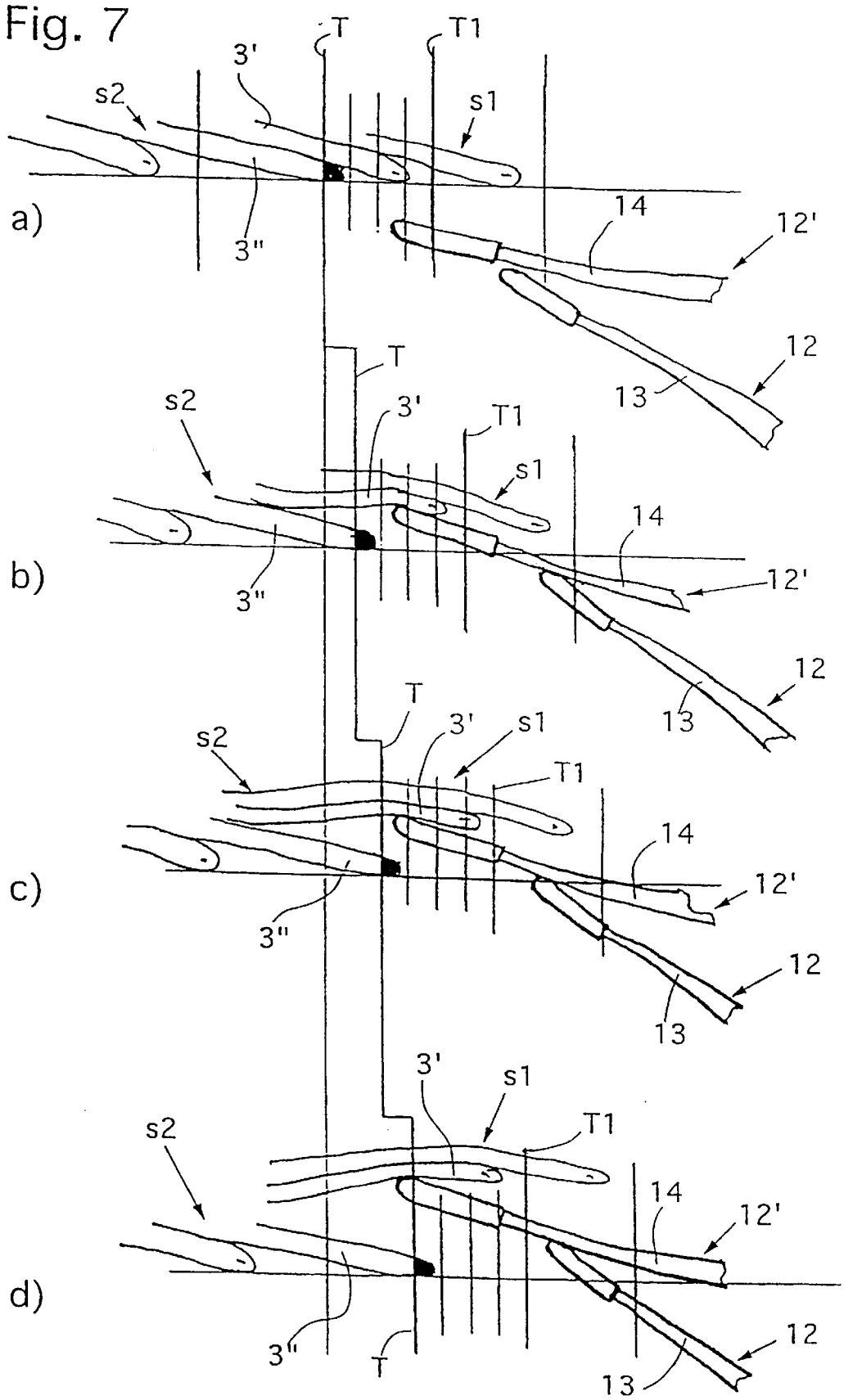
FIGS. 7*a–d* show the product-transfer sequence in a conveying apparatus according to FIG. 6 at different points in time.

A third embodiment of a conveying apparatus according to the invention is shown with reference to FIG. 6, which corresponds in illustrative terms to FIG. 3 and in which both the feed conveyor 1 and the removal conveyor 2 are shown merely in a quite schematic and simplified manner, and to FIG. 7. The same designations are used in FIGS. 1 to 4 and 6 to 7 for corresponding parts. This third embodiment is very similar to the embodiment according to FIGS. 1 and 2. In particular, the grippers 12 of the removal conveyor 2 are of the same design in both embodiments. Unlike the embodiment according to FIGS. 1 and 2, the embodiment which is shown in FIGS. 6 and 7 does not have a deflecting arrangement 16, 33. The operation of deflecting the printed products 3, i.e. of directing them into the open grippers 12, is achieved, in a manner which is still to be described, by control of the clamping parts 13, 14 of the grippers 12.

FIGS. 6*a* and 6*b* illustrate the product receiving situations at two successive points in time. FIGS. 7*a* to 7*d* show even more clearly, in an illustration which is on a larger scale than FIG. 6, with reference to the regions designated T and T1, how the product—receiving operation proceeds over time. In this case, the situation illustrated in FIG. 7*a* corresponds to that according to FIG. 6*a*.

In the embodiment according to FIG. 6, it is important that the clamping parts 13, 14 of the grippers 12, 12' running into the region of the transfer location 4 are controlled such that in each case the trailing clamping part 14 of a gripper 12' and the leading clamping part 13 of the next gripper 12 butt against one another, as is shown in FIGS. 6 and 7. This measure means that there is no interspace, between the clamping parts 14, 13 of successive grippers 12', 12, into which a printed product 3 could pass accidentally. The control of the grippers 12, 12' and of the clamping parts 13, 14 thereof may take place, for example, in a manner similar to that described in EP-A-0 557 680 and the corresponding U.S. Pat. No. 5,388,820.

FIG. 6*a* shows a first point in time, at which the gripper 12" has already gripped a group comprising three printed products 3. The spacings a' and a" between the leading edges of successive products are the same here as the corresponding spacings between these printed products in the fed imbricated formation S. The following gripper 12' is about to grip the group of printed products which is assigned to it, and is designated s1. The length of this group is given by the group boundaries 23 and 23'.

The situation occurring at a later point in time is illustrated in FIG. 6*b*. The gripper 12' is closed and firmly clamps the printed products 3 of the gripped group s1. This group s1 comprises four printed products, of which the rearmost printed product is designated 3'. The next gripper 12 is reaching the transfer location 4 and is ready to receive the printed products 3 of the next group s2.

FIGS. 7*a* to 7*d* show, even more clearly, the procedure at the changeover between the products being received by a gripper 12' and the following gripper 12. These figures illustrate the end region of the group s1, which is gripped by the gripper 12', and the starting region of the following group s2, which runs into the next gripper 12. The last product of the group s1 is designated 3', and the first product of the group s2 is designated 3". It is clear from FIG. 7 that the abutment of the leading clamping part 13 of the gripper 12 against the trailing clamping part 14 of the preceding gripper 12' forms an essentially continuous directing-in surface which ensures that the printed products which are intended to run into the gripper 12 pass satisfactorily into the mouth of said gripper.

It can readily be seen with reference to FIGS. 6 and 7 that in the third embodiment, which is shown in these figures, the printed products 3 are fed to the grippers 12 while maintaining their spacing. Just as in the other embodiments, it is also the case here that, by coordinating the conveying speeds v1 and v2 in relation to the gripper spacing D, it is ensured that the length F of that portion of the received group which projects into the gripper mouth is smaller than the depth E of the grippers (see also FIG. 3*a*).

In the illustration of FIGS. 6 and 7, the two conveying directions A and B form an angle of approximately 90°. Of course, it is also possible, or even desirable, in this embodiment for this angle, just as in the other embodiments, to be greater than 90°.

In all the exemplary embodiments shown, during the time in which the grippers 12, 26 cover a distance corresponding to the gripper spacing D, the printed products 3 are advanced by a distance which corresponds to the length F, which, as is known, is equal to the length of that portion of each group s which projects into the gripper mouth 15. This means that each group s gripped by a gripper 12, 26 always projects into the gripper mouth 15 by the same length F. However, the number of printed products 3 per group s differs and depends on the mutual spacing a of the printed products 3 in the fed imbricated formation S, i.e. a gripper 12, 26 grips one, two or more printed products 3, e.g. up to six products, or even no product at all.

The position of the deflecting arrangement 16, 33 in relation to the removal conveyor 2 is adapted to the design of the grippers 12, 26, i.e. the spacing between the deflecting arrangement 16, 33 and the grippers 12, 26 is selected such that the sought after operation of directing the printed products 3 into the grippers 12, 26 also actually takes place (see FIGS. 1 and 5).

The printed products 3 secured and transported away by the grippers 12, 26 of the removal conveyor 2 may be discharged again at a discharge location in such a way as to re-form an imbricated formation in which the spacings a of successive printed products 3 are the same again as in the original imbricated formation S.

In addition, however, it is also possible to discharge the printed products 3 in groups, i.e. to release and open all of the grippers 12, 26 or some of the grippers 12, 26 irrespective of the other grippers.

What is claimed is:

1. An apparatus for conveying printed products comprising a feed conveyor for continuously feeding printed products in an imbricated formation, with spacings between successive printed products, to a transfer location, a removal conveyor which receives the fed printed products at the transfer location and comprises individually controllable grippers which are arranged at fixed spacings one behind the other in a conveying direction and are configured for gripping printed products, wherein the grippers of the removal conveyor have a depth which is larger than at least the spacing between two printed products following one after the other in the fed imbricated formation, with the result that at least some of the grippers of the removal conveyor can grip at least two printed products with the same mutual spacing which the gripped printed products have in the fed imbricated formation, and wherein for directing in each case a number of fed printed products into the grippers of the removal conveyor without a change in the spacing between respectively successive printed products, a deflecting arrangement is provided which is coordinated with the movement of the grippers past the transfer location and acts periodically and briefly on the printed products running along a normal conveying path toward the transfer location as defined by the feed conveyor and while the printed products maintain their feeding speed, so as to deflect said printed products from the normal conveying path onto another conveying path which is oriented counter to the conveying direction of the removal conveyor.

2. The apparatus as claimed in claim 1, wherein the conveying speeds of the feed conveyor and removal conveyor relate to one another in a given, fixed ratio.

3. The apparatus as claimed in claim 1, wherein the conveying directions of the feed conveyor and removal conveyor form an angle ($\alpha$) which is approximately 90° or greater than 90°.

4. The apparatus as claimed in claim 1, wherein the depth of the grippers is larger than the sum of the spacings between in each case two adjacent printed products of a group of three or more successive printed products.

5. The apparatus as claimed in claim 1, wherein the deflecting arrangement comprises a wheel which can be driven in rotation, with said wheel being provided on its outer periphery with at least one deflecting element which, as it comes into contact with the printed products in the imbricated formation, acts on at least one printed product and deflects the latter onto said another conveying path as the wheel rotates further.

6. The apparatus as claimed in claim 5 wherein the wheel is arranged beneath the conveying path which is defined by the feed conveyor, and so that the conveying path is generally tangent to an upper portion of the outer periphery of the wheel.

7. The apparatus as claimed in claim 6 wherein said wheel is driven to rotate in a direction such that the upper portion of the outer periphery of the wheel moves in the direction in which the products are fed by the feed conveyor.

8. The apparatus as defined in claim 7 wherein the at least one deflecting element is of L-shaped configuration in side view and includes a radial first leg and a second leg which is generally parallel to and radially spaced from the outer periphery of the wheel, and with the second leg extending in a direction from the radial first leg opposite the rotational direction of the wheel.

9. The apparatus as claimed in claim 7, wherein the wheel is driven at a variable speed during each rotation thereof.

10. The apparatus as claimed in claim 1, wherein the deflecting arrangement comprises a suction element which is arranged on the normal conveying path which is defined by the feed conveyor, is driven at the conveying speed of the feed conveyor, and is connected periodically to a negative pressure source which, as it comes into contact with the printed products in the imbricated formation, acts on at least one printed product and deflects the latter onto said another conveying path as it rotates further.

11. The apparatus as claimed in claim 1, further comprising a pressure exerting arrangement which is arranged above the feed conveyor and by means of which the printed products running up to the transfer location are pressed against the feed conveyor in the region of their trailing end, until the printed products are firmly clamped at their leading end by a gripper.

12. The apparatus as claimed in claim 1 wherein the feed conveyor is configured for feeding printed products in an imbricated formation with irregular spacings between successive printed products.

* * * * *